United States Patent [19]

Nicolas et al.

[11] Patent Number: 4,534,837

[45] Date of Patent: Aug. 13, 1985

[54] PROCESS FOR THE MANUFACTURE OF AN ELECTRODE FOR ELECTROCHEMICAL PROCESSES AND A CATHODE FOR THE ELECTROLYTIC PRODUCTION OF HYDROGEN

[75] Inventors: Edgard Nicolas, Meise-Eversem; Louis Merckaert, Brussels, both of Belgium

[73] Assignee: Solvay & Cie, Brussels, Belgium

[21] Appl. No.: 622,222

[22] Filed: Jun. 19, 1984

[30] Foreign Application Priority Data

Jun. 20, 1983 [FR] France ..... 83 10285

[51] Int. Cl.[3] ..... C25B 1/02; C25B 11/04

[52] U.S. Cl. ..... 204/129; 204/290 R; 204/291; 204/292; 427/190; 427/193; 427/201; 427/226; 427/372.2; 427/376.2; 427/376.3; 427/380

[58] Field of Search ..... 204/291, 292, 290 R, 204/129; 427/226, 372.2, 376.2, 376.3, 380, 374.4, 190, 193, 201

[56] References Cited

U.S. PATENT DOCUMENTS

| | | | |
|---|---|---|---|
| 3,661,739 | 5/1972 | Tomilov et al. | 204/291 |
| 3,926,770 | 12/1975 | Hoekje | 204/291 |
| 4,243,503 | 1/1981 | Lieb et al. | 204/291 |
| 4,329,219 | 5/1982 | Druzhinin et al. | 204/291 |
| 4,464,421 | 8/1984 | Howell | 427/376.2 |

OTHER PUBLICATIONS

"Electrodes for Alkaline Water Electrolysis" by D. E. Hall, J.E.C.S., vol. 128, #4, Apr. 1981, pp. 741–746.

E.P.A. 79301963.9 filed 21-9-79, publ. 2-4-80.

*Primary Examiner*—R. L. Andrews

*Attorney, Agent, or Firm*—Robert E. Burns; Emmanuel J. Lobato; Bruce L. Adams

[57] ABSTRACT

An electrically conductive substrate is coated with a material containing an unsintered powder of a metal active for electrochemical proton reduction and colloidal silica and the said material is heated on the substrate successively in an oxidizing atmosphere and then in a reducing atmosphere.

The electrode may be employed as a cathode for electrolytic production of hydrogen in an alkaline medium.

11 Claims, No Drawings

PROCESS FOR THE MANUFACTURE OF AN ELECTRODE FOR ELECTROCHEMICAL PROCESSES AND A CATHODE FOR THE ELECTROLYTIC PRODUCTION OF HYDROGEN

The present invention relates to a process for the manufacture of an electrode for electrochemical processes.

In electrolysis processes, an attempt is usually made to reduce the potentials of the electrochemical reactions at the electrodes to a value which is as low as possible. This is particularly the case, in the electrolysis processes in which gaseous hydrogen is produced at the active surface of a cathode, such as the processes of electrolysis of water, aqueous solutions of hydrochloric acid and aqueous solutions of sodium chloride.

The cathodes which have been most widely employed until the present time for the electrolysis of water or of aqueous solutions of sodium chloride or potassium chloride have generally consisted of mild steel plates or meshes. These known cathodes in fact offer the advantage of being easy to use and low in cost. The hydrogen release overvoltage on these known steel cathodes is, however, relatively high, which increases the cost of electrolysis processes. Steel cathodes have the additional disadvantage of being the site of a gradual corrosion in contact with concentrated aqueous solutions of sodium hydroxide, such as are usually produced in electrolysis cells with selective permeability membranes.

To improve the energy yield of electrolysis processes, cathodes have been proposed which are obtained by applying, on a steel or nickel support, a coating formed by a nickel powder mixed with a polysilicate and by then subjecting the nickel powder to sintering in a reducing atmosphere, at a temperature above 760° C. (Journal of the Electrochemical Society, vol. 128, No. 4, April 1981—D. E. HALL: "Electrodes for alkaline water electrolysis", pages 740 to 746).

In U.S. Pat. No. 4,362,647 (AGENCY OF INDUSTRIAL SCIENCE & TECHNOLOGY), cathodes have been proposed, which are obtained by subjecting a nickel plate or a nickel powder sintered on a conducting support, to two consecutive heat treatments, respectively an oxidation at a temperature above 800° C and a reduction at a temperature of between 300° and 600° C. In this known process, the oxidation is usually carried out at a temperature of between 900° and 1,000° C.

When compared to electrodes made from steel plates or nickel plates as such, these known cathodes generally permit an improvement in the energy yield of the processes of electrolysis of water or of aqueous solutions of sodium chloride.

The invention aims at providing a process for the manufacture of electrodes which, when employed as cathodes in electrolysis processes in which hydrogen is generated, make it possible to improve further the energy yield of the electrolysis process.

Consequently, the invention relates to a process for the manufacture of an electrode for electrochemical processes, according to which an electrically conductive substrate is coated with a material containing a powder of at least one metal which is active for electrochemical reduction of protons and the said material is heated on the substrate, successively in an oxidising atmosphere and then in a reducing atmosphere; according to the invention, use is made of a material in which the abovementioned active metal is in the form of an unsintered powder, associated with colloidal silica.

In the process according to the invention, the active metal which is chosen must be a metal capable of being oxidised by heating in an oxidising atmosphere, and the oxide of which is capable of being reduced to the solid metal state by heating in a reducing atmosphere. The choice of the active metal depends, moreover, on the purpose of the electrode. In the case where the latter is intended to serve as a cathode for electrolytic production of hydrogen in an electrolysis process, it is advantageously chosen from cobalt, iron, manganese and nickel. The substrate may be made of any electrically conductive material which is compatible with the active metal and the oxidation and reduction treatments which are employed. For example, in the case where the active metal is chosen from cobalt, iron, manganese and nickel, the substrate material may be advantageously chosen from these metals and their alloys.

The substrate may be of any shape which is appropriate for the purpose of the electrode. It may be, for example, a full or perforated plate, a wire, a mesh or a stack of beads. It may have a surface appearance which is smooth, a rough surface appearance being preferred, however. It may, if appropriate, be attached to an underlying support made of a different material, for example a material which is a better conductor of electricity, such as copper or aluminium.

The purpose of heating in an oxidising atmosphere is to oxidise the active metal. The choice of the temperature, the atmosphere and the time of heating depends on the active metal which is chosen and consequently must be determined in each particular case by routine laboratory work. On completion of the heating in an oxidising atmosphere, the active metal is in the metallic oxide state.

The purpose of heating in a reducing atmosphere is to reduce this metallic oxide to the metal state. The choice of the heating conditions also depends on the active metal chosen.

According to the invention, the electrode material which is subjected to heating in an oxidising atmosphere contains the active metal powder in the unsintered state, associated with colloidal silica. Thus, according to a first characteristic of the process according to the invention, sintering of the active metal powder is deliberately avoided before the material is heated in an oxidising atmosphere. It is desirable to employ an active metal powder which is as fine as possible. As a general rule, use is made of a powder in which the mean particle diameter does not exceed 50 microns and preferably 30 microns. Powders which are generally highly suitable are those in which the mean particle diameter is between 1 and 25 microns, more particularly those of a mean diameter below 20 microns.

According to the second characteristic of the process according to the invention, the ative metal powder is associated with colloidal silica. The optimum quantity of colloidal silica to be employed depends on various factors, particularly the nature of the active metal and its particle size. In general, colloidal silica is used in the material in a relative quantity by weight which is between 0.5 and 10% by weight of the active metal, the quantities between 0.8 and 4% of this weight being preferred.

In the process according to the invention, colloidal silica can be employed in the form of a gel which is mixed as such with the active metal powder to form the abovementioned material.

According to a particularly advantageous embodiment of the process according to the invention, the active metal powder is dispersed in a solution of colloidal silica, preferably an aqueous solution, to form the abovementioned material which is then applied as such, in the form of a liquid suspension, to the substrate, by any suitable means, for example by dipping the substrate in the suspension, by coating with a brush or roller or by spraying. In this embodiment of the invention, the maximum permissible concentration of silica in the suspension is set by the need to produce a stable colloidal silica solution. It depends on various factors, in particular on the concentration of active metal in the suspension and on the optional presence of additives such as stabilisers for the colloidal solution of thickeners. As a rule, in the case of aqueous solutions, the concentration of silica in the colloidal solution should not exceed 30% by weight, values between 3 and 28% and, more particularly, between 10 and 25%, being desirable.

The active metal powder may be dispersed in the solution of colloidal silica as such and the resultant suspension applied to the substrate. In general, it is desirable to dilute the solution of colloidal silica with water before dispersing the active metal powder in it, so as to facilitate this dispersion and to give the suspension a viscosity which is compatible with good coating of the substrate. The optimum quantity of diluting water can be varied depending on the particle size of the active metal powder, the relative quantity of active metal which is added to the colloidal silica solution and the required viscosity. In practice, good results are obtained by employing a quantity of diluting water such that the weight concentration of active metal in the resultant aqueous suspension is between 10 and 80%, preferably between 15 and 60%, the concentrations between 20 and 50% being particularly advantageous.

According to an alternative form of the embodiment of the invention which has just been described, it is advantageous to subject the abovementioned material to drying on the substrate, before it is heated in an oxidising atmosphere, the purpose of the drying being to remove at least most of the water from the colloidal solution. In this alternative form of the invention, drying is advantageously controlled in order that at its end the water content in the material should not exceed 10%, preferably 5%, of the weight of the material. During the drying, sintering of the active metal powder should be avoided.

In another alternative form of said embodiment of the invention use is made of a colloidal silica solution which additionally contains lithium ions as a stabilising agent. In this alternative form of the invention, the lithium ions may be added to the colloidal silica solution by any suitable means, preferably in form of lithium hydroxide. The lithium ion content in the colloidal solution is preferably controlled so as to produce therein a molar $SiO_2$:$LiO_2$ ratio of between 3 and 25, preferably between 4 and 10. Solutions of colloidal silica which are particularly suitable within the scope of the invention are those described in U.S. Pat. No. 2,668,149 (DU PONT).

In the process according to the invention, both the heating in an oxidising atmosphere are heating in a reducing atmosphere are preferably carried out at temperatures which do not result in either melting or sintering of the metal powder.

For example, in the case where the active metal is chosen from cobalt, iron, manganese and nickel, heating in an oxidising atmosphere may be carried out in air, preferably at a temperature which does not exceed 850° C., and heating in a reducing atmosphere may be carried out in hydrogen at a temperature which does not exceed 600° C. Working temperatures which are particularly suitable are those between 600° and 800° C., and more particularly between 700° and 760° C., in the case of heating in an oxidising atmosphere, and those between 300° and 500° C., and more particularly between 350° and 450° C., in the case of heating in a reducing atmosphere.

In general, the electrode obtained at the end of the heating in a reducing atmosphere may, after cooling, be employed as such in the electrochemical process for which it is intended.

It is nevertheless preferable, according to a particular embodiment of the invention, to subject the electrode to an oxidation treatment at the end of the heating in a reducing atmosphere. This oxidation treatment may be carried out in the surrounding air and is preferably carried out at a temperature above room temperature but not exceeding the maximum temperature of the heating in a reducing atmosphere. A practical means for producing this temperature consists in cooling the electrode in the presence of air at the end of heating in a reducing atmosphere.

In another embodiment of the process according to the invention, a coating containing a metal chosen from chromium, molybdenum, cobalt, nickel, ruthenium, rhodium, palladium, osmium, iridium, platinum, lanthanum and rare earth elements is applied to the electrode, after the heating in a reducing atmosphere. Said coating may be applied at the end of the heating in a reducing atmosphere. In case of said heating in a reducing atmosphere is followed by an additional oxidation treatment, said coating may be applied at the end of said additional oxydation treatment.

All else being equal, this embodiment of the invention permits an additional decrease in voltage in the electrochemical processes, and particularly in electrolysis processes.

In the use of this embodiment of the invention, the coating metal may be applied to the electrode by any suitable means, for example by a plasma jet spraying technique. In the case where the coating metal is chosen from chromium, cobalt, nickel, ruthenium, rhodium, palladium, osmium, iridium and platinum, deposition by an electrolytic process may usefully be employed. To this end, it has been found particularly advantageous to produce the electrolytic deposition of the chosen metal in an electrolyte containing ions of the said metal, in which the electrode is the site of an electrolytic proton reduction.

According to an advantageous alternative form of this embodiment of the invention, to apply the coating metal to the electrode, a layer of a thermally decomposable compound of the said metal is first deposited on it, then the said compound is subjected to a thermal decomposition treatment so as to liberate an oxide of the said metal, and then the oxide is heated in a reducing atmosphere. This alternative form of this embodiment of the process according to the invention may be applied to particular advantage in the case where the coating metal is chosen from lanthanum and the rare earth elements. In this alternative form, the thermally decomposable compound may be any compound which, on being heated in a controlled atmosphere, liberates an oxide of the metal which is chosen for the coating. It may, for example, be a nitrate, sulphate, phosphate, chloride, a carboxylic acid salt such as a formate, acetate, propionate or oxalate. It may be employed in the solid state, for example in the form of a powder, or in the liquid state, for example in the form of a molten salt, a suspension or a solution. The heating temperature and the controlled atmosphere must be chosen as a function of the selected metal and the thermally decomposable compound which is employed. In some particular conditions (especially when the thermally decomposable compound is a nitrate or an oxalate), the heating may be carried out in an inert atmosphere (for example in a nitrogen or argon atmosphere). In practice, however, it is preferred to carry out the heating in an oxidising atmosphere, usually in air, at a temperature below 1,000° C., preferably not exceeding 850° C.; temperatures between 100° and 800° C. and more particularly those not exceeding 750° C. are preferable. Heating in a reducing atmosphere may generally be carried out in a hydrogen atmosphere, at a temperature not exceeding 600° C., usually between 200° and 500° C., depending on the metal chosen for coating the electrode.

The electrodes obtained by the process according to the invention are found to have applications in various electrochemical processes such as, for example, cathodic protection, electrolysis and fuel cells.

The invention consequently also relates to the use of an electrode obtained by the process according to the invention as a cathode for the electrolytic production of hydrogen by electrochemical proton reduction in an aqueous alkaline medium. Such use is found to be particularly advantageous in the electrolysis cells for the production of aqueous solutions of alkali metal hypochlorite, and in the cells with a permeable diaphragm and with a selective permeability membrane for the electrolysis of aqueous solutions of sodium chloride, such as those described in French Patent Application Nos. 2,164,623, 2,223,083, 2,230,411, 2,248,335 and 2,387,897 (SOLVAY & Cie).

The merit of the invention will become apparent from the description of the following examples of application.

In each of the examples which follow, electrolysis of an aqueous brine containing 255 g of sodium chloride per kg was carried out in a laboratory cell with vertical electrodes separated by a NAFION (DU PONT DE NEMOURS) cationic selective permeability membrane.

The cell, cylindrical in shape, incorporated an anode formed by a circular titanium plate pierced with vertical slots and coated with an active material of mixed crystals consisting of 50% by weight of ruthenium dioxide and 50% by weight of titanium dioxide.

The cathode consisted of an unperforated disc the composition of which is specified in each example.

The total surface area of each electrode in the cell was 102 $cm^2$ and the distance between the anode and the cathode was fixed at 6 mm, the membrane being arranged at equal distances from the anode and the cathode.

During the electrolysis, the anode chamber was continuously supplied with the abovementioned aqueous brine and the cathode chamber with a dilute aqueous solution of sodium hydroxide, the concentration of which was controlled to maintain a concentration of approximately 32% by weight of sodium hydroxide in the catholyte. The temperature in the cell was maintained at a constant 90° C. In all the tests, the electrolysis current density was maintained at a fixed value of 3 kA per $m^2$ of cathode area. Chlorine was thus produced at the anode and hydrogen at the cathode.

First series of tests (according to the invention)

EXAMPLE 1

(a) Composition of the cathode: The cathode employed was an electrode obtained in the manner described below, according to the invention.

A coating composition was prepared by mixing the following components:

| | |
|---|---|
| nickel powder: | 100 g |
| aqueous solution of colloidal silica: | 10 g |
| thickener: | 1 g |
| water: | 200 g |

The nickel powder employed in this coating composition had a particle size such that its specific surface was approximately equal to 0.6 $m^2/g$.

A colloidal solution containing approximately 20% by weight of silica and 2.1% by weight of lithium oxide was used for the colloidal silica solution.

A polysaccharide was employed as a thickener.

Six successive coats of this coating composition were applied on a nickel plate serving as substrate, the plate being subjected to drying for half an hour in an oven at 70° C. after the application of each coat. The thickness of the coating material formed in this way on the substrate, at the end of the application of the six coats, was approximately 100 microns and it weighed approximately 400 g per $m^2$ of area.

The substrate and its coating were then heated for 5 hours in an oven at 750° C., in the presence of air, so as to oxidise practically all the nickel in the coating. After being cooled, they were treated for an hour at 450° C. in an oven through which a stream of hydrogen was passed, and then cooled to room temperature, while the hydrogen atmosphere was maintained in the oven.

(b) Results of electrolysis: The electrode obtained at the end of the process just described was fitted as such as a cathode in the electrolysis cell. During the electrolysis, the voltage at the cell terminals became constant at 3.29 V.

EXAMPLE 2

(a) Composition of the cathode: An electrode was manufactured by following the method described in Example 1, except in respect of the final cooling: the latter, which followed the treatment in a hydrogen atmosphere at 450° C., was carried out in air, so as to produce a partial re-oxidation of the nickel.

(b) Results of electrolysis: The voltage at the terminals of the electrolysis cell employing the electrode obtained in this way as a cathode stabilised at 3.16 V. The cathode potential was further measured by means of the measurement method using a Luggin capillary connected to a saturated calomel reference electrode in KCl (ECS) (Modern Electrochemistry, Bockris and Reddy, Plenum Press, 1970, vol. 2, pages 890 and 891). The cathode potential rapidly stabilised at approximately −1.18 V.

EXAMPLE 3

(a) Composition of the cathode: The method described in Example 1 was first followed to manufacture the cathode. The electrode obtained in this way was subjected to five consecutive coatings with an aqueous solution of a water-soluble compound of lanthanum, so as to give, correspondingly, a total weight of approximately 50 g of lanthanum per $m^2$ of the electrode area. At the end of each of the five coating operations, the electrode was subjected to drying for half an hour in an oven at 70° C., then to an oxidising heating for 5 minutes in an oven at 750° C. in the presence of air and then to a reduction treatment for an hour in an oven at 450° C. through which a stream of hydrogen was passed.

(b) Results of electrolysis: The voltage at the terminals of the cell employing this cathode became constant at 3.19 V.

EXAMPLE 4

(a) Composition of the cathode: The operations of the procedure described in Example 3 were repeated, the following changes being introduced therein:

the solution of the water-soluble compound of lanthanum was replaced with an aqueous solution of a water-soluble compound of molybdenum;

the quantity of solution employed in the five coating operations was controlled so as to give, correspondingly, a layer, on the electrode, of approximately 150 g of molybdenum per $m^2$ of electrode area;

oxidising heating was carried out for 1 hour at 400° C.

(b) Results of electrolysis: The voltage at the terminals of the electrolysis cell became steady at 3.13 V.

EXAMPLE 5

(a) Composition of the cathode: An electrode was first manufactured by the method described in Example 1. The electrode thus obtained was placed as a temporary cathode in the electrolysis cell described above, and electrolysis was started as described. As soon as the voltage at the cell terminals had stabilised, a solution of hexachloroplatinic acid was added to the catholyte, in a quantity which was controlled so as to give, correspondingly, an electrolytic deposit of approximately 2 g of platinum per $m^2$ of area of the temporary cathode.

(b) Results of electrolysis: After the hexachloroplatinic acid solution had been added as described above, the voltage at the cell terminals decreased and stabilised at approximately 3.13 V.

Second series of tests (reference tests)

EXAMPLE 6

In this test, the cell cathode consisted of a plate of sand blasted nickel, unmodified. During the electrolysis, the voltage at the cell terminals stabilised at 3.36 V.

EXAMPLE 7

(a) Composition of the cathode: The coating composition described in Example 1 was employed and was applied as five successive coats to a nickel plate, the plate being subjected to drying for half an hour in an oven at 70° C. after the application of each coat. The thickness of the coating material formed on the nickel plate in this way was approximately 100 microns and it weighed approximately 400 g per $m^2$ of area.

The plate and its coating were then heated for 30 minutes in an oven at 750° C. through which a stream of hydrogen was passed, so as to produce sintering of the nickel powder.

(b) Results of electrolysis: The voltage at the cell terminals became constant at 3.33 V during the electrolysis.

EXAMPLE 8

(a) Composition of the cathode: The procedure employed for the electrode of Example 2 was followed, but, in addition, sintering of the nickel powder was carried out before heating in an oxidising atmosphere. To produce the sintering, the substrate and its coating were heated for 30 minutes in an oven at 750° C. in a hydrogen atmosphere.

(b) Results of electrolysis: The cathode potential, measured as in Example 2, stabilised at −1.20 V.

Comparison of the results of electrolysis which were obtained in the tests of Examples 1 to 5 with those of Examples 6 and 8 shows that the cathodes produced by the process according to the invention generally make possible a substantial decrease in voltage.

Comparison of Examples 2 and 8 shows further that the absence of sintering before the heating in an oxidising atmosphere has no harmful effect on the cathode potential.

What we claim is:

1. Process for the manufacture of an electrode for electrochemical processes, according to which an electrically conductive substrate is coated with a material containing a powder of at least one metal which is active for electrochemical proton reduction and the said material is heated on the substrate, successively in an oxidizing atmosphere and then in a reducing atmosphere, characterized in that a material is employed in which the abovementioned active metal is in the form of an unsintered powder, associated with colloidal silica.

2. Process according to claim 1, characterized in that use is made of a material in which the quantity of colloidal silica is between 0.8 and 4% by weight of active metal.

3. Process according to claim 1, characterized in that a suspension of the active metal powder in a colloidal silica solution is used as the material.

4. Process according to claim 3, characterized in that use is made of a suspension containing from 20 to 50% by weight of active metal in an aqueous solution of colloidal silica containing a weight of silica of between 0.8 and 4% by weight of active metal.

5. Process according to claim 3, characterized in that use is made of a colloidal silica solution which contains lithium ions in a quantity controlled so as to produce a molar $SiO_2$:$LiO_2$ ratio of between 4 and 10.

6. Process according to claim 1, characterized in that use is made of a substrate made of a material chosen from cobalt, iron, manganese, nickel and alloys of these metals, an an active metal chosen from cobalt, iron, manganese and nickel.

7. Process according to claim 1, characterized in that said material is heated at a temperature between 600° and 800° C. in an oxidizing atmosphere and at a temperature between 300° and 500° C. in a reducing atmosphere.

8. Process according to claim 1, characterized in that at the end of the heating in a reducing atmosphere, there is applied on the electrode a coating containing a metal chosen from chromium, molybdenum, cobalt, nickel, ruthenium, rhodium, palladium, osmium, iridium, platinum, lanthanum and rare earth elements.

9. Process according to claim 8, characterized in that, to apply the coating metal on the electrode, a layer of a thermally decomposable compound of the said metal is first deposited on it, then the said compound is subjected to a thermal decomposition treatment so as to liberate an oxide of the said metal and the oxide is then heated in reducing atmosphere.

10. Cathode for the electrolytic production of hydrogen by electrochemical proton reduction in an aqueous alkaline medium, characterized in that it is an electrode produced by the process according to claim 1.

11. Process for the production of hydrogen in an electrolytic cell, wherein hydrogen is electrolytically produced on a cathode, wherein the cathode is an electrode produced by a process according to claim 1.

* * * * *